US006492956B1

(12) United States Patent
Fischer et al.

(10) Patent No.: US 6,492,956 B1
(45) Date of Patent: Dec. 10, 2002

(54) RF CURRENT INJECTING ANTENNA DEVICE

(75) Inventors: Joseph F. Fischer, Redondo Beach, CA (US); Allen Fischer, Rancho Palos Verdes, CA (US)

(73) Assignee: Fischer Custom Communications, Inc., Torrance, CA (US)

( * ) Notice: Subject to any disclaimer, the term of this patent is extended or adjusted under 35 U.S.C. 154(b) by 42 days.

(21) Appl. No.: 09/658,762

(22) Filed: Sep. 8, 2000

(51) Int. Cl.[7] ..... H01Q 7/08

(52) U.S. Cl. ..... 343/788; 343/850

(58) Field of Search ..... 343/788, 789, 343/856, 850, 720, 742, 787, 741

(56) References Cited

U.S. PATENT DOCUMENTS 5,633,648 A * 5/1997 Fischer ..... 343/788

* cited by examiner

*Primary Examiner*—Don Wong
*Assistant Examiner*—Chuc Tran
(74) *Attorney, Agent, or Firm*—Ladas & Parry

(57) ABSTRACT

An apparatus for, and method of, replacing conventional antennas which transmit radio frequency energy from radio frequency transmitters. The invention provides for the use of any conductive surface as a transmitting antenna by taking advantage of the fact that any electrical conductor or surface that is 0.1 wavelengths or longer will radiate RF energy when injected with sufficient current. The RF current injecting antenna device, employing the principles of an instrument transformer, couples RF energy from a transmitter to a linear conductive element or a conductive surface. The useful frequency range that has been demonstrated for the device is 2 MHz to 1 GHz.

22 Claims, 6 Drawing Sheets

Where:
$R_1$ - Primary winding resistance
$R_W$ - Core losses
$L_p$ - Primary open circuit inductance
$L_L$ - Primary to secondary leakage inductance
$R_S$ - Secondary winding resistance
$C_S$ - Secondary distributed capacitance

RF CURRENT INJECTING ANTENNA DEVICE

FIELD OF THE INVENTION

This invention relates to an apparatus for coupling radio frequency energy to conductive surfaces for radiation and, more specifically, providing the coupling by current injection.

BACKGROUND OF THE INVENTION

A conventional antenna utilizes current being developed on its structure to generate a radiated radio frequency electric field. Conventional antennas are available in many forms and sizes. The lower the frequency of transmission, the longer the antenna required to properly develop a usable radiated power. Therefore, in some low frequency applications, the antenna becomes large, perhaps difficult to mount to a nearby structure, and may require a significant outlay of funds for the purchase of a proper antenna and its mounting hardware.

One type of antenna is a form of wire or conductor arranged in a linear configuration, such as a metallic rod. If the current distribution on such a conductor is known, then the radiation pattern and radiated power can be determined. This determination is based upon the integration of the effects from each differential element of current along the conductor.

A commonly-accepted expression for the electric field generated at large distances from a relatively short (less than a quarter wave length of the radiated signal) vertically polarized antenna is, $$E_\theta = j\frac{60\pi\sin\theta}{r\lambda} I_0 L_e e^{-j\beta r} \tag{1}$$

where:

$L_e$=effective length of antenna $I_0$=Current at center of antenna in amperes (RMS)

r=distance in meters to the observation point $\lambda$=wavelength (meters)

$\beta=2\pi/\lambda$ $E_\theta$=volts/meter $\theta$=angular position of the observation point $j=\sqrt{-1}$ This expression demonstrates that any conductor developing an RF current can be considered an antenna and the field generated by a conductor of any length is a function of the current generated in the conductor.

The ability of an antenna or metallic structure to radiate is a function of its radiation resistance. The radiation resistance, along with the current on the antenna, is responsible for generating RF power radiating outward from the antenna.

The radiation resistance for a monopole-type antenna, such as a linear metal conductor, that is less than a quarter wavelength is commonly given by:

$$R_r = 40\pi^2\left(\frac{L_e}{\lambda}\right)^2 \tag{2}$$

where, as in equation 1, $L_e$ is the effective height of the antenna or one half the physical length of the antenna. For example, a 0.1 wavelength monopole antenna will have a radiation resistance of at least 5 ohms, and 0.35 wavelength monopole will have a radiation resistance of approximately 50 ohms. Note that the radiation efficiency of a monopole antenna can be improved by "top-loading" the antenna, or placing a disk of metal or radial wires at one end of the antenna. The disk or wires add capacitance, and therefore impedance matches the antenna to a lower frequency than if the disk or wires were not present. This permits a greater current over a longer length of the antenna, thus improving the radiation efficiency.

The power radiated by a monopole type of antenna is given by $$P_r = I^2 R_r \tag{3}$$

where I=current in amperes.

The vertical electric field developed by an isotropic antenna, in terms of radiated power is commonly given by:

$$E_\theta = \sqrt{\frac{30P_r}{r}} \text{ volts/meter at the observation point} \tag{4}$$

From the above model, a monopole metallic structure 0.1 wavelengths long at 10 MHz, in theory, is physically 3 meters in length. The electrical effective height is approximately one half its physical length or 1.5 meters. Many metallic structures in today's environment, not initially intended to be used as antennas, will meet this physical requirement. Such structures may include portions of a vehicle, a building, or a ship.

Direct coupling of RF energy to structures like those cited above is generally not feasible. Serious safety concerns arise when sources of large amounts of current are directly connected to metallic structures that may come into contact with human beings. Also, impedance mismatches between the source of the RF energy and the metallic structures are likely to result in most of the RF energy being reflected back to the source. In extreme cases, the reflected energy may damage the RF source.

Coupling of RF energy to conductors can also be accomplished by using a series capacitor. As is known in the art, this technique has been used to couple RF energy to an electrical power wire (such as electrical wiring in a house), which then acts as an antenna. The series capacitor presents a high impedance to the frequency of the electrical power carried by the wire, but presents a low impedance to the higher frequency RF energy. Thus, the RF energy can be coupled to the electrical power wire. This technique still requires a direct connection to the conductor, therefore retaining the safety and direct physical connection concerns.

In another field of technology, related only in the environment involving RF energy and associated RF electrical signals, are instrument transformers, or devices commonly referred to as RF current injection probes, which are well known. These devices are designed to be used in laboratory instrumentation applications for purposes of making measurements; that is, RF injection probes have been typically used to couple RF currents into the wires of a device under test. Such testing is typically required during electromagnetic interference susceptibility testing required by civil regulatory agencies like the Federal Communications Commission, the European Economic Union, and the Military when certifying a piece of equipment or confirming conformance to electromagnetic compatibility standards.

In U.S. Pat. No. 5,633,648, issued May 27, 1997, to the Applicant, an apparatus for utilizing instrument transformers, or RF current probes, for receipt of RF energy is disclosed. However, these instrument transformers are constructed so as to operate at lower currents than instrument transformers used for current injection. Furthermore, losses induced by instrument transformers used for receipt of RF energy are of less concern, since circuitry within the RF receiver coupled to the instrument transformer can be used to amplify the RF signal to an acceptable level for further processing. Therefore, instrument transformers constructed for use as RF current injection probes are constructed with limitation of transformer induced losses as a primary concern.

Known RF current injection probes generate RF current in any metallic wire, rod, or surface. Such RF current injection probes may be constructed in many different embodiments well known in the art. Two exemplary embodiments are described below.

A first embodiment of an RF current injection probe comprises a toroidal magnetic core and winding, which provide the primary winding of a transformer, and a single metallic wire, rod or other conductor passing through the aperture of the toroid, acting as a secondary winding. In this embodiment, the primary winding, when connected to an RF current source, will cause RF current flow to be induced in the secondary winding.

A second embodiment of an RF current injection probe is one half of a toroidal or rectangular magnetic core and a winding, representing the primary winding of a transformer. The end surface faces of the toroid core or rectangular core are electrically insulated and placed close to a metallic surface. The metallic surface acts as the secondary winding. When RF current is applied to the primary winding, the metallic surface will have RF current flow induced within it.

A need exists in the art for coupling RF energy to existing metallic structures, so as to allow the structures to be used as RF radiating surfaces. The RF energy must be coupled in a safe and efficient manner so as to maximize the radiation of RF power while minimizing the risk to people in the vicinity and the RF energy source.

SUMMARY OF THE INVENTION

It is an object of the present invention to provide an apparatus and method that combine RF transmission antenna technology with RF current injection probe technology in a heretofore unknown manner to eliminate conventional antennas by utilizing existing wires or surfaces of metallic structures. It is a further object of the present invention to provide for coupling of RF energy in a manner that maximizes the RF power radiated while minimizing the risks associated with such RF energy coupling.

The present invention eliminates the use of conventional antennas by taking advantage of the fact that any electrical conductor or surface being 0.1 wavelengths long or longer, when injected with significant current will radiate power.

The present invention accomplishes this goal by providing a transformer capable of effectively coupling transmitter power to a wire filament or surface, and creating current that will cause radiated power to emanate from the wire or surface.

The useful frequency range of some embodiments of the present invention has been demonstrated to be from 2 MHz to 1 GHz.

One of the preferred embodiments of the invention is a toroidal transformer with the primary connected to a transmitter, and the secondary consisting of any wire or metallic structure at least 0.1 wavelengths long. The secondary wire or metallic structure can be connected directly to a fastener located in the earth or to a metallic structure. No impedance termination or special treatment of the secondary is required. The primary is a winding wound around the toroidal magnetic core. This embodiment of the present invention provides the capability to use metallic structures, such as guy wires, flag poles, metal pipe, and architectural steel rebar, as transmitting antennas. The metallic structure must merely be positioned within the center of the toroidal transformer and RF energy will be coupled from the primary to the metallic structure.

Another preferred embodiment is that of a magnetic core, consisting of a half toroid or straight rectangular bar of magnetic material with its primary winding wound around the magnetic core (in a solenoid fashion). The secondary winding consists of a metallic surface, which can be a portion of a vehicle, ship superstructure, sail boat stay or mast or other metallic architectural structure. These surfaces, when injected with a current, will radiate an RF field directly proportional to the current injected. The source of the RF currents, originates from an RF transmitter output being connected and impedance matched to the primary winding of the transformer. When the ends of the toroidal core half or rectangular bar are placed in close proximity to the surface, the coupling efficiency is increased, generating more current in the surface. This embodiment of the present invention allows for nearly any conductive surface, such as metal surfaces present on a vehicle, ship, or building, to be used as a transmitting antenna. The magnetic core must be placed adjacent the conductive surface and oriented appropriately, and RF energy will be coupled from the primary to the conductive surface.

DETAILED DESCRIPTION OF PREFERRED EMBODIMENTS

Figure 1:
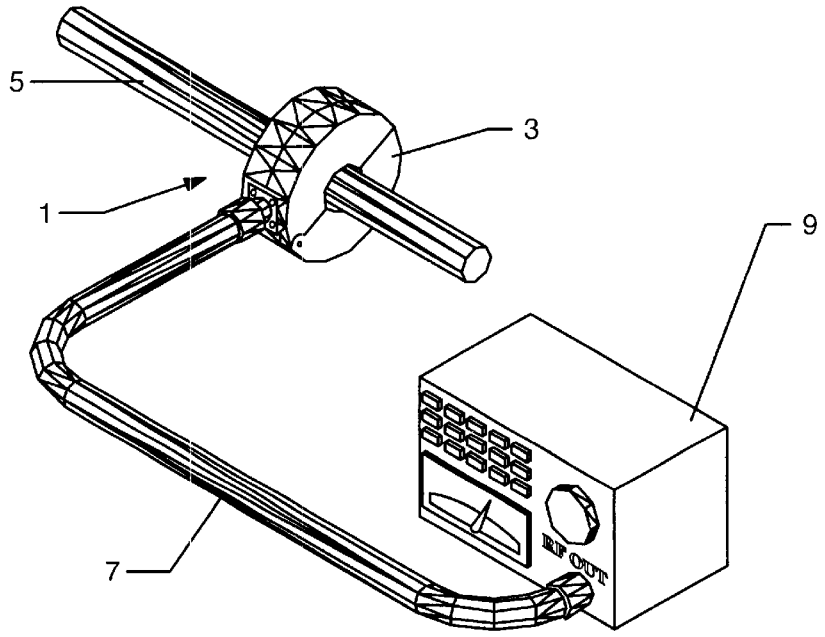
FIG. 1 is a conceptual diagram of a transmitting antenna installation provided by a first embodiment of the present invention.

FIG. 1 is a conceptual diagram of a transmitting antenna installation provided by a first embodiment of the present invention. A coupled transmitting antenna device 1 having a toroidal primary 3 is clamped around a conductor 5 acting as a secondary. A 50 ohm cable 7 couples the RF energy from a transmitter 9 to the coupled transmitting antenna device 1.

The primary of coupled transmitting antenna device 1, when connected to a source of RF energy, will develop current in the secondary that is proportional to the following relationship:

Transmit power input=Transformer power output+ Transformer Insertion loss (watts)

10 log $P_{in}$=dB watts input 10 log $P_{out}$=dB watts output 10 log Insertion loss (watts)=dB insertion loss (dB watts)

dB $P_{in}$−dB $_{Pout}$=dB insertion loss.

Hence, the efficiency of the present invention is a function of reducing the insertion loss between the primary and secondary windings, recognizing that the secondary has a constantly changing impedance versus frequency. The smaller the insertion loss, the greater the power delivered to the secondary conductor; and the larger the amount of radiated power at a given distance from the equivalent antenna.

Figure 2:
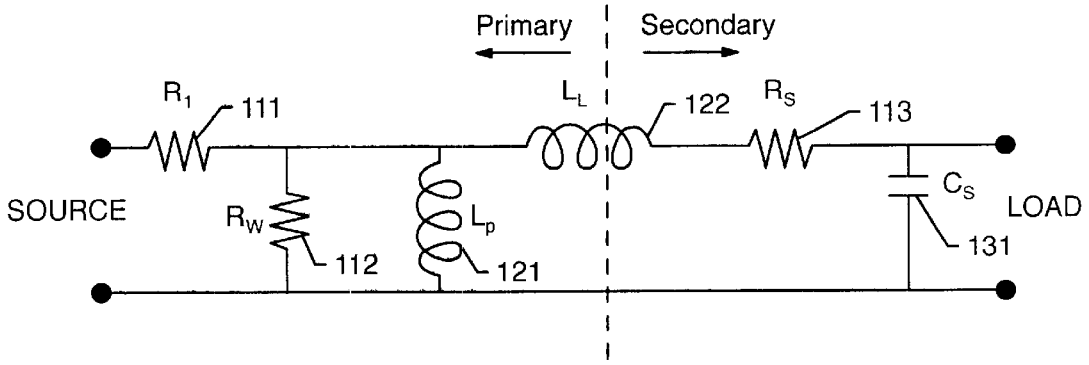
FIG. 2 is a circuit diagram of the equivalent circuit of the RF current injector of the present invention.

FIG. 2 is a circuit diagram of the equivalent circuit of the RF current injector of the present invention. The circuit diagram is typical of all transformers, but will be used to explain the sources of insertion loss and to clarify the unique features of the present invention.

As shown in FIG. 2, a source input to the primary winding of a transformer will encounter a series resistance 111 representing the resistive loss of the primary winding, a parallel resistance 112 representing the transformer core losses, and a parallel inductance 121 representing the primary open circuit inductance. Coupling the primary winding to the secondary winding provides a series inductance 122 representing primary to secondary leakage inductance. The losses in the secondary can be represented by a series resistance 113 representing the resistance of the secondary winding and a parallel capacitance 131 representing the distributed capacitance of the secondary.

The performance of the RF current injector of the present invention can be optimized by maximizing the primary open circuit inductance and by minimizing: (1) the primary and secondary winding losses; (2) primary to secondary leakage inductance; (3) air gap losses, which are part of core losses; (4) other core losses; and (5) all distributed capacitance. Minimizing core losses is achieved by keeping the magnetic flux density at such a level that core permeability remains within its linear permeability range. Keeping the permeability within its linear range also reduces waveform distortion in any signals transmitted through the RF current injector.

These factors are generally controlled by the construction and orientation of the RF current injector. The primary leakage inductance and primary resistance are a function of the winding on the core. The secondary leakage inductance and secondary winding resistance are a function of the geometry of the windings to each other, and their relationship to the magnetic core.

The necessity to couple energy efficiently over large frequency ranges, i.e., 2 MHz to 1 GHz, requires that the magnetic coupling be achieved with structures having very large impedance variations of both the transmitter and the equivalent antenna. As an example, an equivalent monopole-type antenna will typically vary from two meters to thirty meters in length, which means that it will vary in length from less than a one-tenth wavelength long to several wavelengths long.

Another major consideration for the RF current injecting antenna device is its ability to minimize heat rise, which is accomplished by minimizing hysteresis and eddy current losses, which is especially difficult over the frequency range of 2 MHz to 1 GHz. Eddy current and hysteresis losses are a function of the core material resistivity, so by using high resistivity materials, eddy currents are reduced since less current flows in the magnetic core. Eddy currents are also controlled by core geometry and air gaps between core halves.

Figure 4:
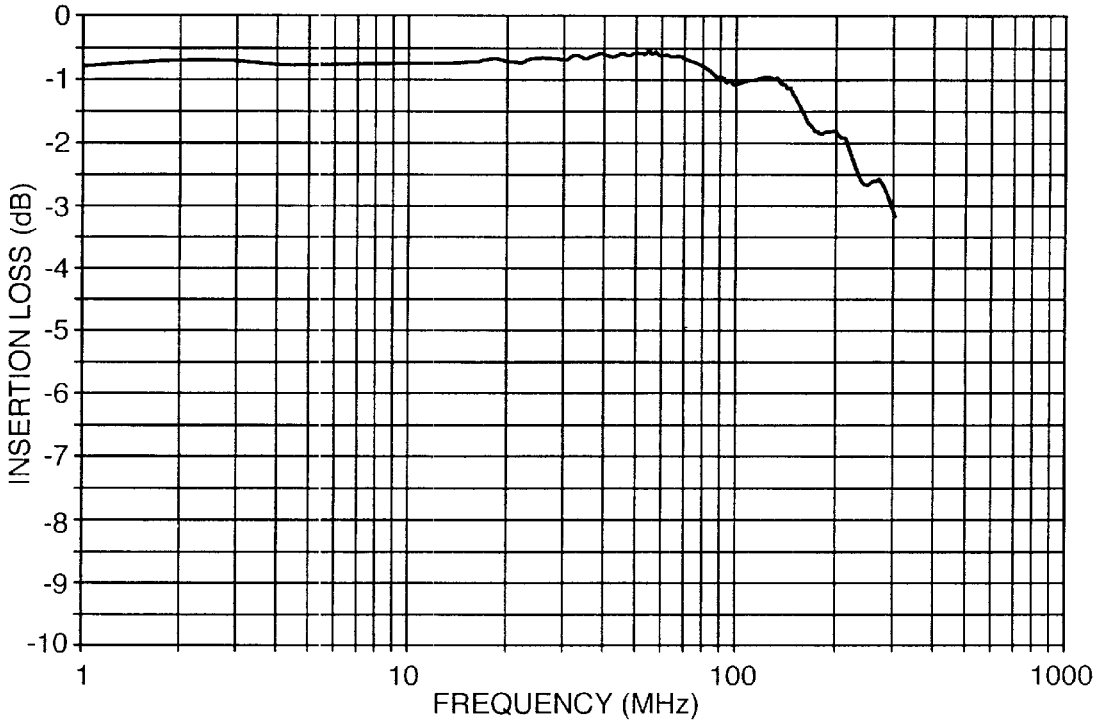
FIG. 4 is a graph of insertion loss over frequency for a first toroidal embodiment of an RF current injecting antenna device.
Figure 5:
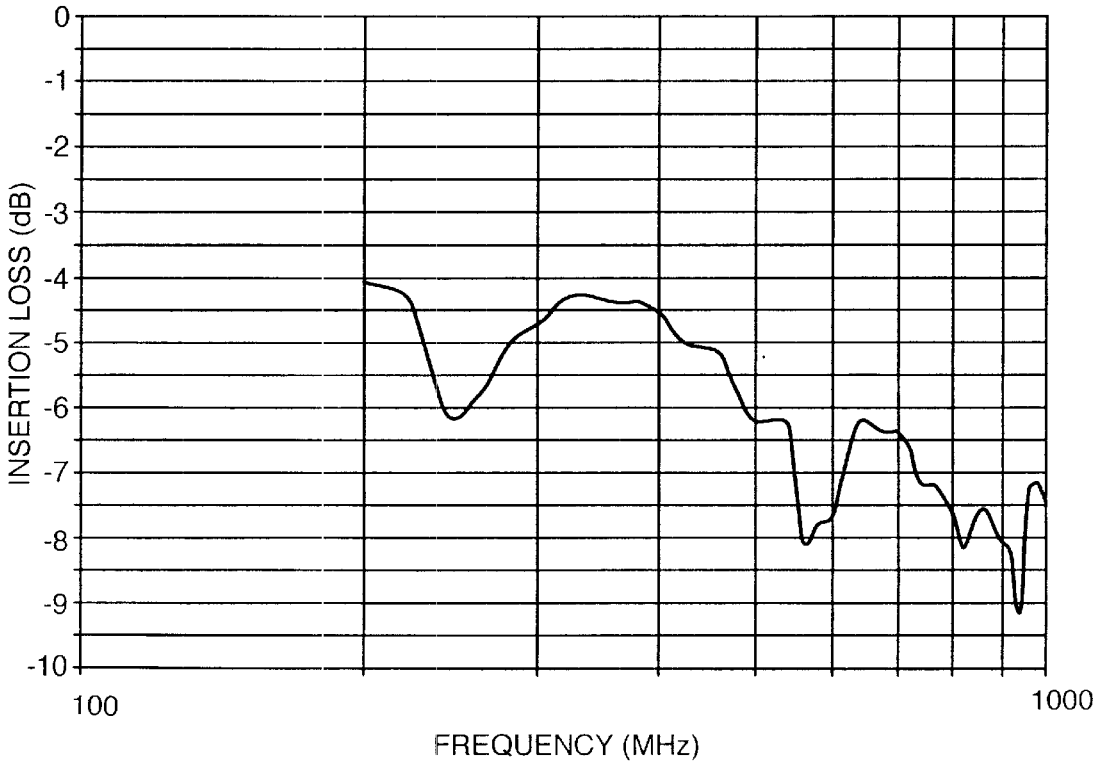
FIG. 5 is a graph of insertion loss over frequency for a second toroidal embodiment an RF current injecting antenna device.

Returning to FIG. 1, the RF current injecting antenna device 1 minimizes insertion loss such that a current of significant magnitude is generated in the secondary when the primary 3 is driven with power levels up to one kilowatt and the secondary winding 5 has a minimum length of 0.1 wavelength. The measured insertion loss achieved over the 2 MHz to 1 GHz frequency range is shown in FIGS. 4 and 5. If the RF current injecting antenna device is driven by a 1 kilowatt transmitter and the secondary conductor is 0.35 wavelengths long, the device will provide a current of 4 amperes over the frequency range of 2 MHz to 200 MHz; and 1.8 amperes over the frequency range of 200 MHz to 1 GHz. These currents would generate over 100 microvolts/meter at a distance of 1000 kilometers for frequencies of 2 MHz to 30 MHz; and greater than 500 microvolts/meters at a distance of 50 kilometers for a "Line of Sight Condition," for frequencies of 30 MHz to 1 GHz. The "Line of Sight" is defined as the distance that two antennas are optically visible to each other; and depends upon their physical heights above the surrounding terrain (typical distances can range from 15 Kilometers to as much as 100 kilometers).

Figure 3A:
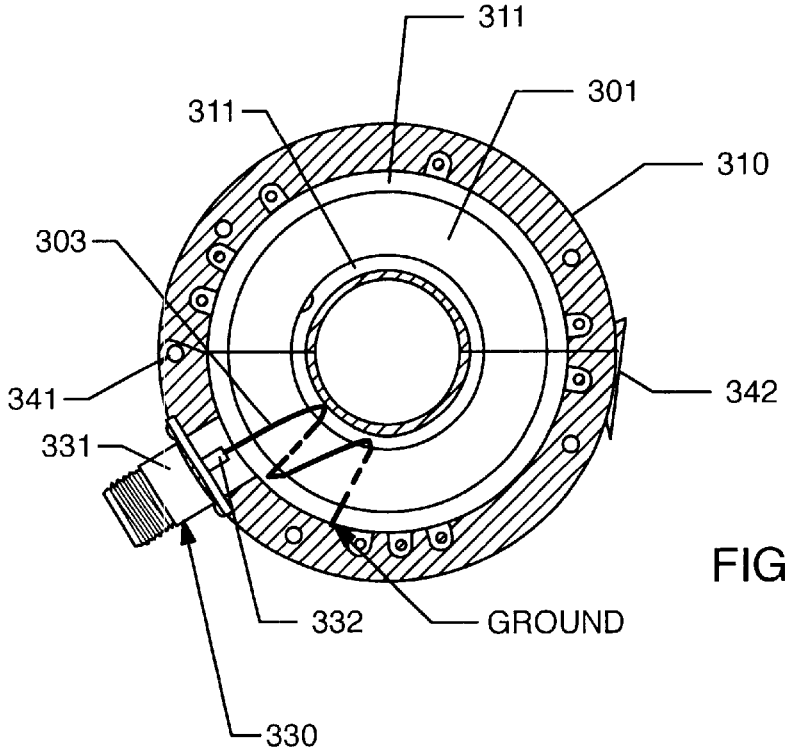
FIG. 3A shows a horizontal cross-sectional view of the toroidal primary of a first embodiment of the RF current injecting antenna device provided by the present invention.
Figure 3B:
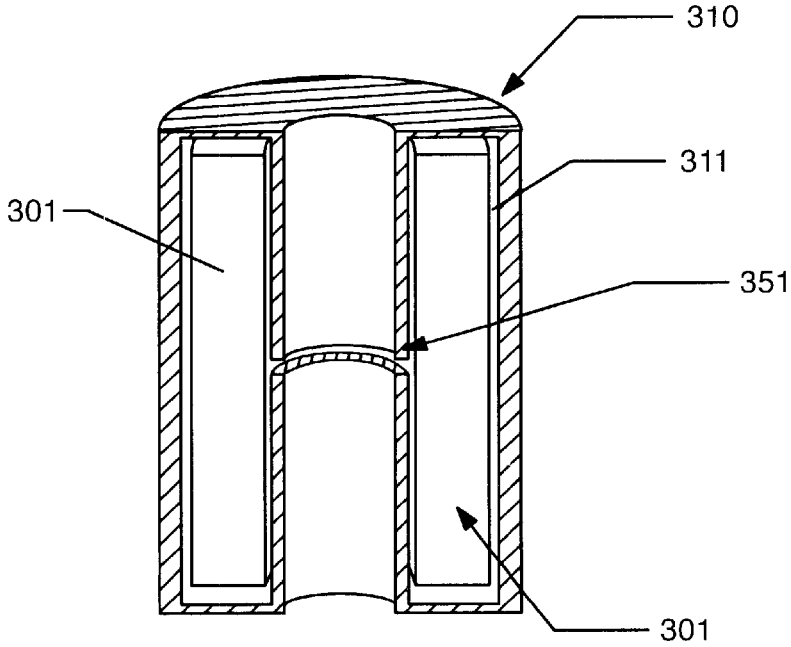
FIG. 3B shows a vertical cross-sectional view the toroidal primary of a first embodiment of the RF current injecting antenna device provided by the present invention.

FIGS. 3A and 3B show multiple views of a typical clamp-on RF current injecting antenna device primary. FIG. 3A shows a horizontal cross-section exposing the relationship of the magnetic core 301 and its winding 303 to the housing 310 and feed connector 330. FIG. 3B shows a vertical cross-section of one half of the clamp-on RF current injecting antenna device primary. The magnetic core 301 is split lengthwise into two halves. FIG. 3A also shows the features that allow the transmitting transformer primary to be clamped around a secondary conductor. A hinge 341 allows the primary to be hinged open and positioned around a conductor. A releasable latch 342 allows the two core halves to be latched together.

In FIG. 3A, the magnetic core 301 and primary winding 303 are contained within a housing 310. The magnetic core 301 may be comprised of various magnetic core materials known in the art. The primary winding 303 may be wound around the magnetic core for a plurality of turns. The number of turns of the primary winding 303 and the magnetic core materials will provide different inductive and resistive characteristics, affecting the frequency response and thus the insertion loss of the device. The primary winding 303 may consist of a single turn around the core or several turns around the core. Typically, the primary winding 303 only covers one half of the core 301, but may be extended around both core halves. The winding 303 may be terminated with a connection to the housing 310 as a ground, or it can be terminated in a balanced to unbalanced transformer (typically referred to as a BALUN) as described below.

An RF signal is coupled into the transmitting transformer primary through a connector 330. Typical connectors are BNC, SMA, or N-style coaxial connectors. If a coaxial connector is used, the shield 331 portion of the connector 330 is coupled to the housing, while the inside conductor 332 of the connector 330 is coupled to the primary winding 303. The primary winding 303 is terminated with a connection to the housing 310. The primary winding 303 and magnetic core 301 are insulated from the housing 310 by an electrical insulating layer 311. The insulating layer 311 comprises insulating materials well known in the art.

The core halves of the magnetic core 301 are generally in contact with each other when the clamp-on RF current injecting antenna device is closed, but, in some instances, an intentional air gap may separate the core halves. However, even when the core halves are in contact with each other, a minute air gap may still exist even though the core faces may be polished to a very smooth finish and pressed tightly against one another. Recalling the discussion above, this air gap will result in air gap losses. The so-called air gap loss does not occur in the air gap itself, but is caused by the magnetic flux fringing around the gap and reentering the core in a direction of high loss. As the air gap increases, the fringing flux continues to increase, and some of the fringing flux strikes the core perpendicular to the core, and sets up eddy currents. As discussed above, core materials with high resistivity will reduce these currents.

FIG. 3B shows an air gap 351 within the interior portion of the housing 310. This air gap 351 is required to prevent forming a shorted tertiary turn around the primary winding 303. If no air gap were present, the shorted turn of the shield would prevent the transmitting transformer primary 3 from coupling RF current to the secondary 5.

As indicated above, the embodiment of the invention shown in FIGS. 3A and 3B is clamped around a conductor that is to be used as a transmitting antenna. Current flow in the primary winding induces a magnetic field with closed flux lines substantially parallel to the toroidal core. This magnetic field then induces current flow in the conductor clamped within the device, which results in RF energy transmission.

The performance of the RF current injector of the present invention may be improved by using a transmission line transformer to couple the RF energy from a transmitter to the RF current injector. If the winding 303 is terminated to the housing 310, an unbalanced to unbalanced (UNUN) transmission line transformer is preferably used to couple RF energy to the input end of the winding 303 of the RF current injector. Alternatively, a balanced to unbalanced transformer (BALUN) may be used to couple RF energy to the RF current injector. In this configuration, the winding 303 will not be terminated at the housing 310. Instead, both the input end and the termination of the primary winding 303 are connected to the balanced terminals of a BALUN. The unbalanced ends of the BALUN are connected to a coaxial cable carrying the RF energy from a transmitter. A BALUN may also be used if the RF current injector has no external shield connected to ground. Use of transmission line transformers improves impedance matching and thus minimizes losses between the transmitter and the current injector. Both BALUNs and UNUNs are well known in the art and are commercially available. However, specially made UNUNs may be required to properly match a transmitter output to the input of the RF current injector.

FIG. 4 is a graph of the insertion loss versus frequency for a device according to the first embodiment of the present invention. Note that this embodiment provides less than 1 dB of insertion loss between 1 and 100 MHz, and only up to 3 dB of insertion loss to 300 MHz. FIG. 5 is a graph of the insertion loss versus frequency for a device according to the first embodiment of the present invention, but with a slightly shorter lengthwise dimension and using different core materials. This embodiment provides less than 10 dB of insertion loss up to 1 GHz.

Other embodiments of the present invention are used to couple RF energy to metallic surfaces that are difficult to surround with the toroidal device discussed above. When at least a portion of the metallic structure comprises a substantially planar surface, surface injection embodiments of the RF current injecting antenna device may be used. These embodiments may comprise a one-half toroid with a primary winding on the half-toroid or a one-half rectangular bar with a primary winding around the bar.

Figure 6A:
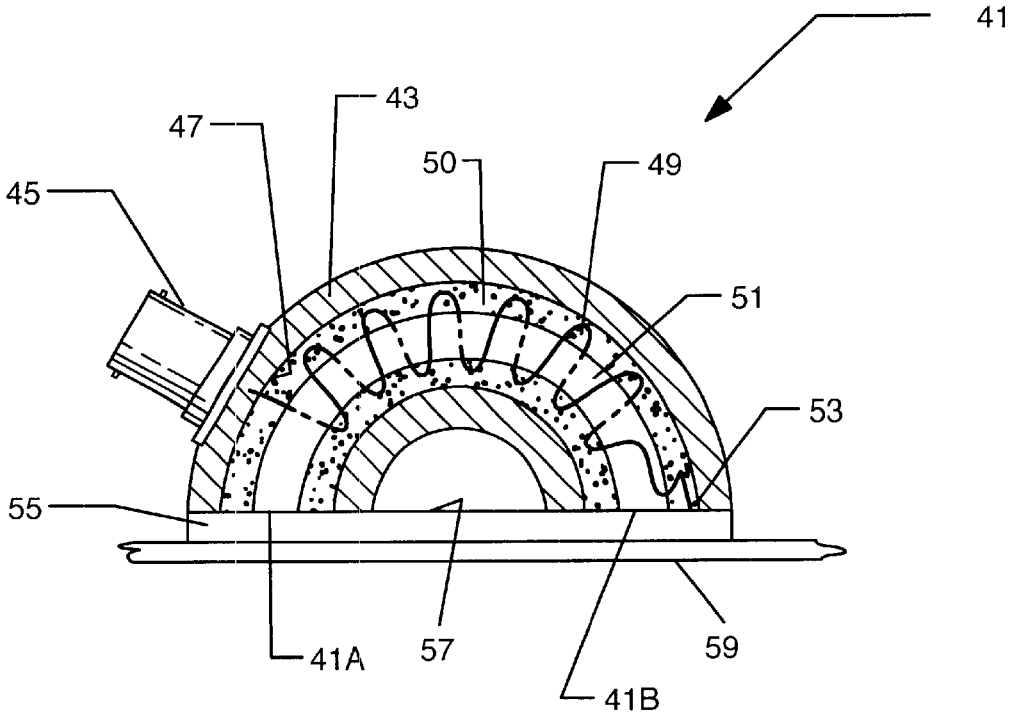
FIG. 6A shows a cross-section view of the half-toroidal primary of a second embodiment of the RF current injection antenna device provided by the present invention.
Figure 6B:
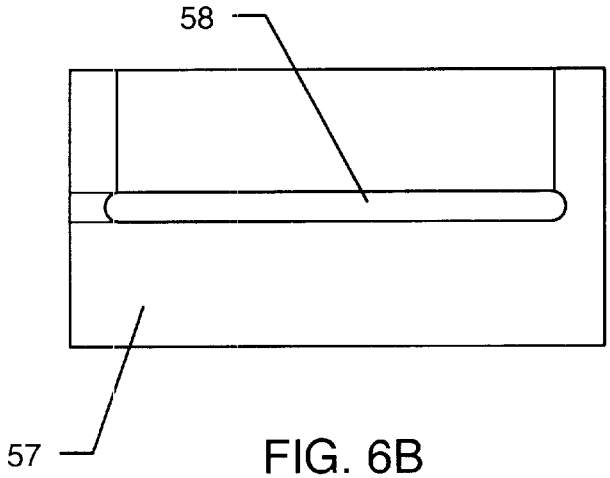
FIG. 6B shows the base of the half-toroidal primary of a second embodiment of the RF current injection antenna device provided by the present invention.

FIGS. 6A and 6B show the half-toroid surface injection embodiment 41 of the RF current injecting antenna device. Shown in these figures is an external shielded housing 43 employed to eliminate electric field pickup. Shown also is the half toroidal core 51 and a primary winding 49. wound thereabout. The injection loss of the RF current injecting device can be controlled by the design of the core 51, winding 49, and the width of the air gap 58 in the copper layer 57 on the dielectric, phenolic, base 55 of the RF current injecting antenna device 41. The core 51 and winding 49 are insulated from the housing 43 by an insulating layer 50. The dielectric base 55 of the RF current injecting antenna device 41 is placed directly upon the conductive surface from which RF energy is to be radiated. For maximum effectiveness, the ends 41A, 41B of the half-toroid within the RF current injecting antenna device 41 should be placed flat and directly adjacent the conductive surface 59.

The winding 49 has a first end 47 connected to the center conductor of the connector 45 and a second end 53 connected to the external shielded housing 43. In an alternative embodiment, the first end 47 may be connected to an unbalanced to unbalanced transformer (UNUN), similar to the configuration discussed above for the clamp-on RF current injecting antenna device.

In the embodiment of the invention shown in FIGS. 6A and 6B, the primary winding wound around the half-toroidal core 51 induces a magnetic field with flux lines that are again generally parallel to the half-toroid core 51. Since the flux lines must form a closed loop, the flux lines exit one end of the half-toroid core 51 and enter the other end of the half-toroidal core 51. The magnetic field will then induce a current flow in the conductive surface 59 that is perpendicular to the magnetic field, which will result in RF energy transmission. As indicated above, maximum current flow and, therefore, maximum RF energy transmission, occurs when the ends of the half-toroidal core 51 are placed flat upon and directly adjacent to the conductive surface 59.

Figure 7A:
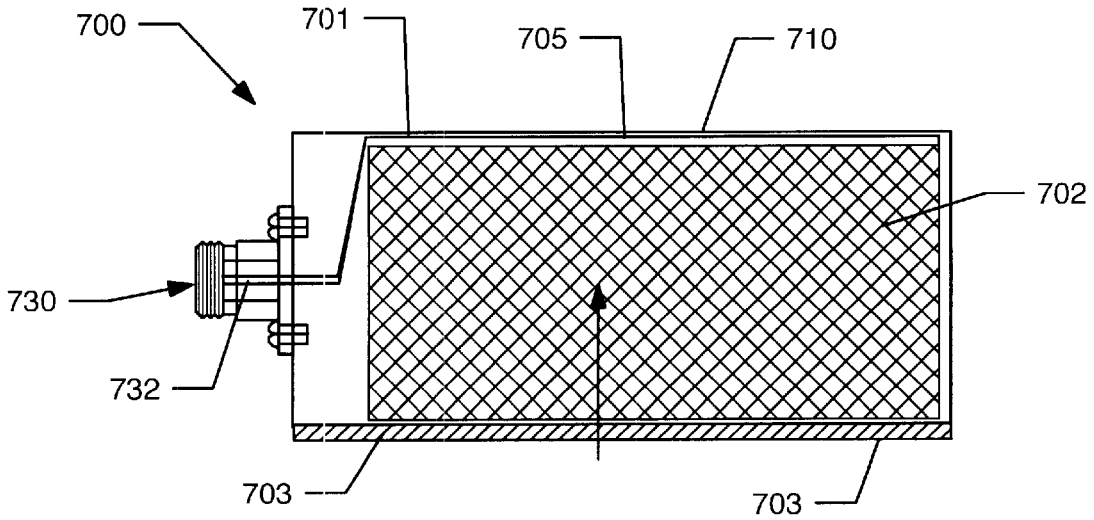
FIG. 7A shows a side view of the rectangular bar primary of a third embodiment of the RF current injecting antenna device provided by the present invention.
Figure 7B:
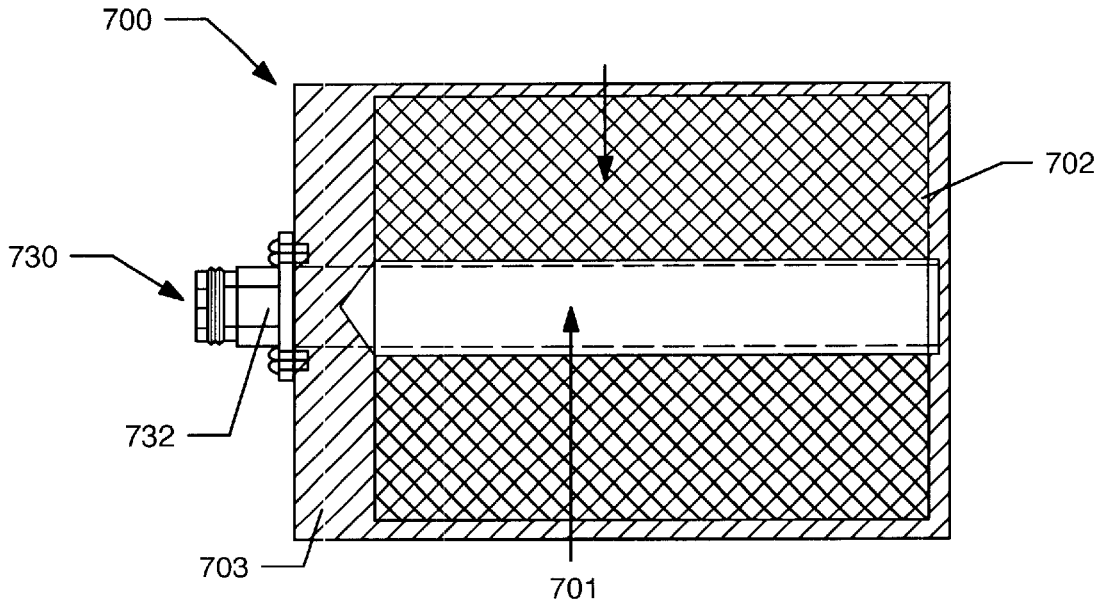
FIG. 7B shows a top view of the rectangular bar primary of a third embodiment of the RF current injecting antenna device provided by the present invention.

FIGS. 7A and 7B show another embodiment of the RF current injecting antenna device for surface injection. FIG. 7A is a side view of the device and FIG. 7B is a top view of the device. In this embodiment, the RF current injecting primary 700 comprises a primary winding 701 wound around a magnetic core 702 with a rectangular shape. The primary winding 701 and magnetic core 702 are contained within a conductive housing 710, but are insulated from the housing 710 by an insulating layer 705. RF energy is directed into the RF current injecting primary 700 through a connector 730. The center conductor 732 of the connector 730 is connected to the primary winding 701. The connector shield 731 is connected to the housing 710. The end of the primary winding 701 is also connected to the housing 710. The RF current injecting primary 700 also has a phenolic, dielectric base 703, which insulates the conductive housing 710.

In operation, the RF current injecting primary 700 is placed flat adjacent the surface of the conductive surface that is to be used for radiating RF energy. The magnetic core 702 with the primary winding 701 is oriented so that the primary winding 701 is wound in a plane generally perpendicular to the plane of the conductive surface. RF current directed into the primary winding from an RF transmitter will induce RF current flow in the surface of the metallic structure. This current flow will result in the radiation of RF energy. Note also that RF energy may be coupled to this embodiment of the RF current injecting antenna device with a UNUN or a BALUN, as previously described.

Figure 8:
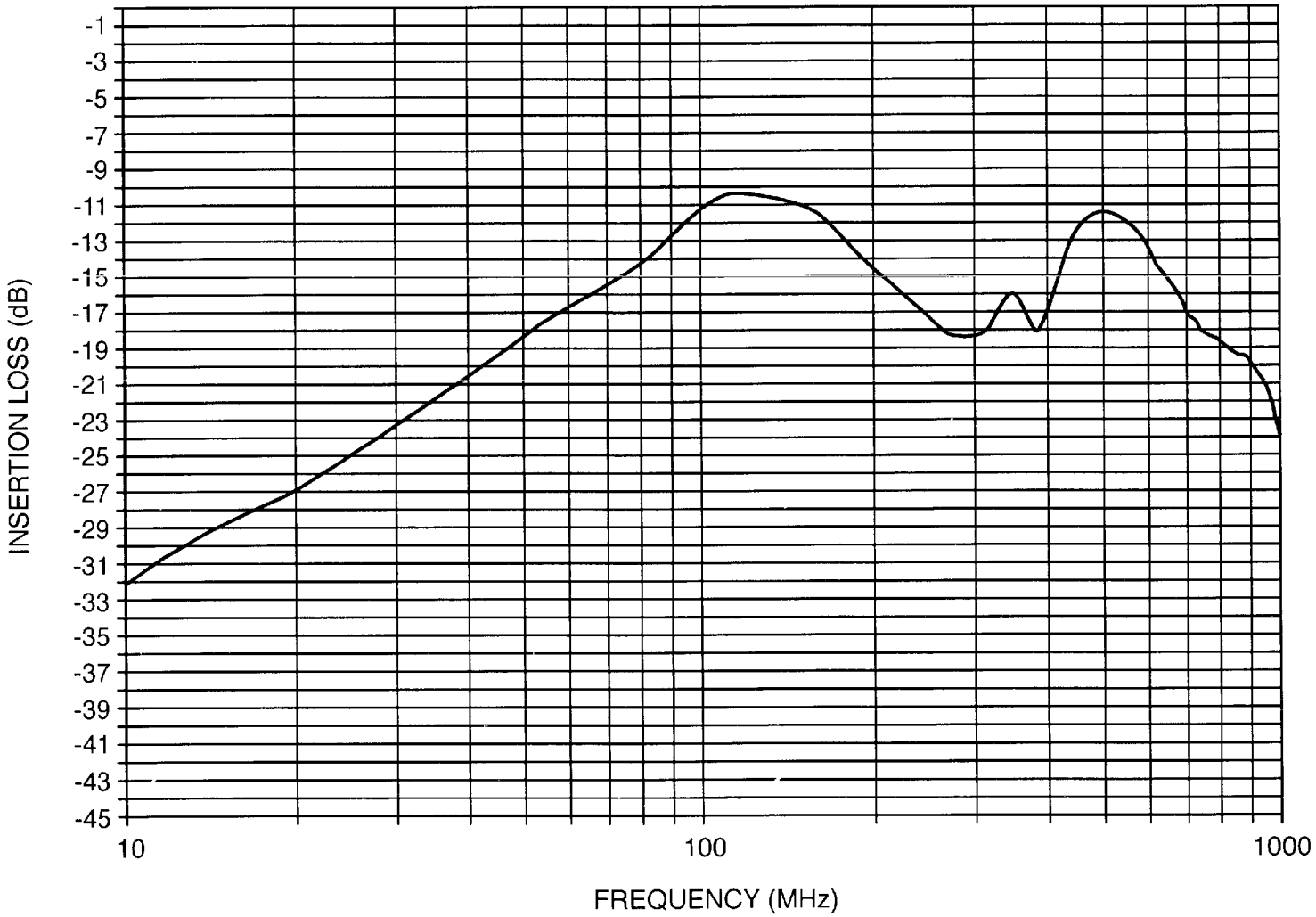
FIG. 8 is a graph of the insertion loss versus frequency for a surface current injection embodiment of the RF current injection antenna device of the present invention.

FIG. 8 is a graph of the insertion loss versus frequency for an RF current injecting antenna device according to the third embodiment of the present invention. Note that this embodiment provides between 10 dB and 32 dB of insertion loss over a wide frequency range. The data presented are for the case where the secondary, that is, the metallic surface, is a minimum of 0.2 wavelengths long and the primary is one-third the surface width. When a 1 kilowatt RF transmitter is used to provide RF energy to the RF current injecting antenna device of this embodiment, an 80 milliamperes current flow is induced in the metallic surface at 10 MHz. At 100 MHz, the current flow is 1 amperes; at 400 MHz, the current flow is 0.5 amperes; and at 1 GHz, the current flow is 0.2 amperes. With these current flows, a 100 microvolt/meter electric field is generated at 10 MHz at a distance of 30 kilometers. At 100 MHz, the 100 microvolt/meter field would be developed at a maximum distance of 380 kilometers. Note that the location of the placement of the RF current injecting antenna device on the conductive surface will effect the efficiency and pattern of RF energy radiated by the conductive surface. Since RF currents have a tendency to flow to sharp edges, placement of the RF current injecting antenna device close to an edge (such as a comer of a metallic structure on a building) may increase the amount of RF energy radiated.

From the foregoing description, it will be apparent that the present invention has a number of advantages, some of which have been described above, and others of which are inherent in the embodiments of the invention described above. Also, it will be understood that modifications can be made to the RF current injecting antenna device and the method for RF current injection for RF transmission described above without departing from the teachings of subject matter described herein. As such, the invention is not to be limited to the described embodiments except as required by the appended claims.

We claim:

1. An RF current injecting antenna device for coupling RF energy, created in an RF transmitter, to a conductor, said device comprising:

an outer conducting non magnetic housing;

a toroidal magnetic core having a central aperture, said core insulated from said housing;

a primary winding wound about said core, said primary winding having a first end receiving said RF energy and a second end, said primary winding insulated from said housing between said first end and said second end, wherein said conductor is positioned within said aperture, said conductor comprising a secondary winding, and said conductor has a length of at least 0.1 wavelength of the RF energy.

2. An RF current injecting antenna device as claimed in claim 1, wherein said second end of said primary winding connects to said outer conducting non-magnetic housing.

3. An RF current injecting antenna device as claimed in claim 1, wherein said first end of said primary winding connects to an unbalanced to unbalanced transmission line transformer.

4. The RF current injecting antenna device as claimed in claim 1, wherein said conductor comprises any elongate metallic structure including guy wire, flag pole, metal pipe, and architectural steel rebar.

5. The RF current injecting antenna device as claimed in claim 1 capable of coupling currents to said conductor over a frequency range of 2 MHz to 1 GHz.

6. The RF current injecting antenna device as claimed in claim 1 wherein said primary is driven with RF energy with a power level of up to 1 kilowatt with insertion losses of 0 dB to 10 dB over a frequency range of 2 MHz to 1 GHz.

7. An RF current injecting antenna device for coupling RF energy, created in an RF transmitter, to a conductive surface, said device comprising:

an outer conducting non-magnetic shield;

a magnetic core contained within said outer conducting non-magnetic shield, said core insulated from said shield;

a primary winding wound about said core, said primary winding having a first end receiving said RF energy and a second end, said primary winding insulated from said shield between said first end and said second end;

an insulating base affixed to an outside surface of said outer conducting non-magnetic shield and positioned between said conductive surface and said outer conducting non-magnetic shield;

wherein said primary winding wound around said core and said core are positioned such that the lines of magnetic flux induced by the RF energy coupled into said primary winding are oriented in a plane generally perpendicular to a plane parallel to said conductive surface.

8. An RF current injecting antenna device as claimed in claim 7, wherein said magnetic core comprises a semi-toroidal magnetic core having ends defined by a toroid cross-sectioned along a plane containing the axis of the toroid, said ends of said semi-toroidal magnetic core positioned substantially flat and adjacent to said conductive surface.

9. An RF current injecting antenna device as claimed in claim 7, wherein said magnetic core comprises a rectangular magnetic core, said core positioned adjacent to said conductive surface and said primary winding wound around said core in a plane generally perpendicular to a plane parallel to said conductive surface.

10. An RF current injecting antenna device as claimed in claim 7, wherein said second end of said primary winding connects to said outer conducting non-magnetic shield.

11. An RF current injecting antenna device as claimed in claim 7, wherein said first end of said primary winding connects to an unbalanced to unbalanced transmission line transformer.

12. The RF current injecting antenna device as claimed in claim 7 wherein said conductive surface comprises a portion of a vehicle, ship, or building.

13. The RF current injecting antenna device as claimed in claim 7 wherein said conductive surface has a minimum length of 0.1 wavelength of said RF energy.

14. The RF current injecting antenna device as claimed in claim 7 capable of coupling current s to said conductive surface over a frequency range of 10 MHz to 1 GHz.

15. A method or providing radiated RF energy, developed in a RF transmitter, from a conductor, said method comprising the steps of:

providing an RF transmitter generating RF energy;

providing a toroidal magnetic core having a central aperture and a primary winding wound about said core, said primary winding having a first end and a second end, said magnetic core and said primary winding mounted within a conducting non-magnetic housing, said magnetic core insulated from said housing and said primary winding insulated from said housing at said first end and between said first end and said second end;

positioning the conductor within said central aperture, said conductor comprising a secondary winding and said conductor having a length of at least 0.1 wavelength of the RF energy; and connecting said RF energy from said transmitter to said first end of said primary winding.

16. The method as claimed in claim 15 wherein:

the conductor may be selected from any elongated metallic structure including guy wires, flag poles, metal pipe, and architectural steel rebar.

17. The method as claimed in claim 15 capable of radiating RF energy from 2 MHz to 1 GHz.

18. A method of providing radiated RF energy, developed in a RF transmitter, from a conductive surface, said method comprising the steps of:

providing an RF transmitter generating RF energy;

providing a magnetic core and a primary winding wound about said core, said primary winding having a first end and a second end, said magnetic core and said primary winding mounted within a conducting non-magnetic housing, said magnetic core insulated from said housing and said primary winding insulated from said housing at said first end and between said first end and said second end;

connecting said RF energy from said transmitter to said first end of said primary winding;

providing an insulating surface between said conducting non-magnetic housing and said conductive surface positioning said conducting non-magnetic housing adjacent to said conductive surface; and positioning said primary winding and said core such that the lines of magnetic flux induced by the RF energy connected into said primary winding are oriented in a plane generally perpendicular to a plane parallel to said conductive surface.

19. The method as claimed in claim 18 wherein said magnetic core comprises a semi-toroidal magnetic core having ends defined by a toroid cross-sectioned along a plane containing the axis of the toroid, said ends of said semi-toroidal magnetic core positioned substantially flat and adjacent to said conductive surface.

20. The method as claimed in claim 18, wherein said magnetic core comprises a rectangular magnetic core, said core positioned adjacent to said conductive surface and said primary winding wound around said core in a plane generally perpendicular to a plane parallel to said conductive surface.

21. The method as claimed in claim 18 wherein the conductive surface comprises a portion of a vehicle, ship, or building.

22. The method as claimed in claim 18 capable of radiating RF energy over a frequency range of 10 MHz to 1 GHz.

* * * * *